United States Patent [19]

Horton et al.

[11] Patent Number: 5,011,241

[45] Date of Patent: Apr. 30, 1991

[54] ADJUSTABLE STORAGE SYSTEM FOR AUDIO AND/OR VIDEO MEDIA

[76] Inventors: James M. Horton, 287 S. Clarkson Str., Denver, Colo. 80209; Eric L. Bunge, 300 E. 17th Ave., Number 1422, Denver, Colo. 80203

[21] Appl. No.: 298,110

[22] Filed: Jan. 17, 1989

[51] Int. Cl.[5] ..... A47B 88/00

[52] U.S. Cl. ..... 312/330.1

[58] Field of Search ..... 220/22.1; 312/183, 330 R; 206/561, 565, 387; 211/184

[56] References Cited

U.S. PATENT DOCUMENTS

| | | | |
|---|---|---|---|
| 769,855 | 9/1904 | Brower | 220/22.1 |
| 965,517 | 7/1910 | Hayes | 220/22.1 |
| 1,367,245 | 2/1921 | Ebrenz | 211/184 X |
| 1,767,645 | 6/1930 | Barrett | 211/184 |
| 2,368,349 | 1/1945 | Cornish | 211/184 X |
| 2,415,054 | 1/1947 | Weil | 211/184 X |
| 3,606,006 | 9/1971 | Raybois | 206/565 X |
| 4,341,314 | 7/1982 | Feuerstein | 211/184 |
| 4,346,806 | 8/1982 | Bustos | 211/184 X |
| 4,395,955 | 8/1983 | Pfeifer | 211/184 X |
| 4,591,148 | 5/1986 | Slater | 24/306 |

*Primary Examiner*—Joseph Falk

*Attorney, Agent, or Firm*—W. Edward Johansen

[57] ABSTRACT

An adjustable storage system for storing audio and/or video media, such as either cassettes or diskettes, and/or other media, such as books, which are arranged in a row. The adjustable storage system is used in combination with a cabinet which has at least one drawer with a bottom wall and a front wall. The adjustable storage system includes a plurality of stops and a plurality of dividers. Each stop has a bottom surface and a front surface which is at an angle of slightly more than ninety degrees to the bottom surface. The top edge of the stop contacts the rear wall of the last of the audio and/or video media and/or other media in the row. Each divider has a bottom surface. A rectangular sheet of a first velcro material with either loops or hooks is mechanically coupled to the bottom wall of each drawer. A piece of a second velcro material with either hooks or loops is mechanically coupled to the bottom surface of each stop and each divider. Each stop and each divider is detachably coupled to the bottom wall of each drawer of the cabinet. The adjustable storage system may be adjusted to store cassettes, diskettes and other media of different sizes by moving each of the plurality of stops and each of the plurality of dividers.

3 Claims, 2 Drawing Sheets

Fig. 1.
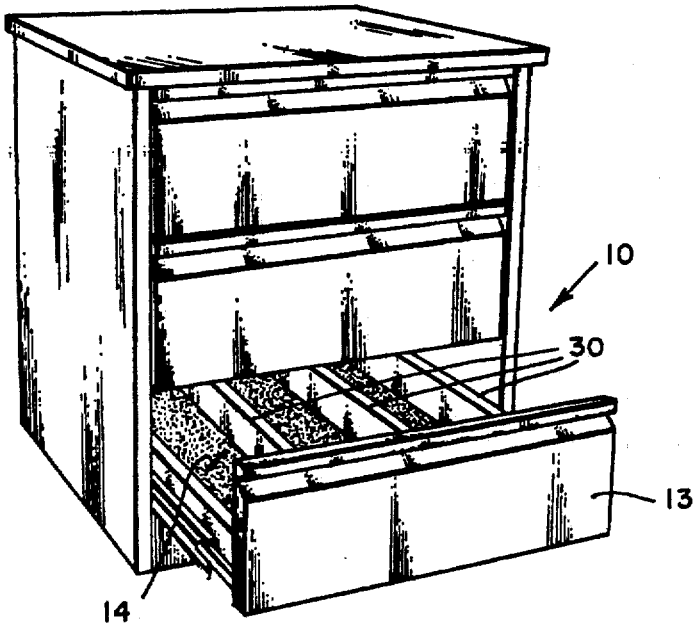
Fig. 3.
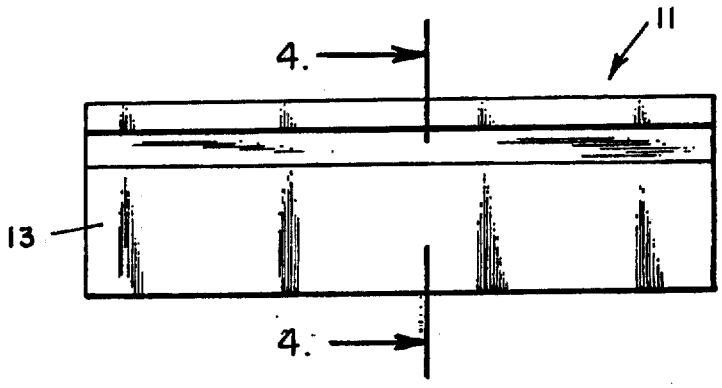
Fig. 4.
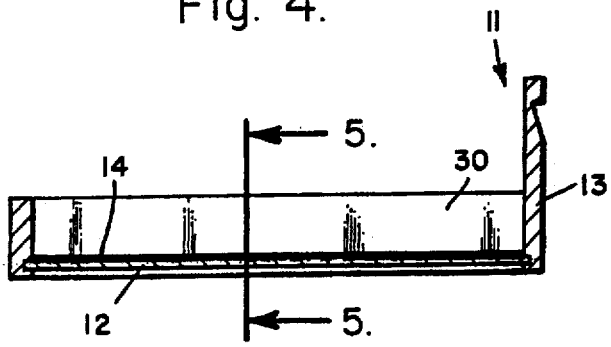
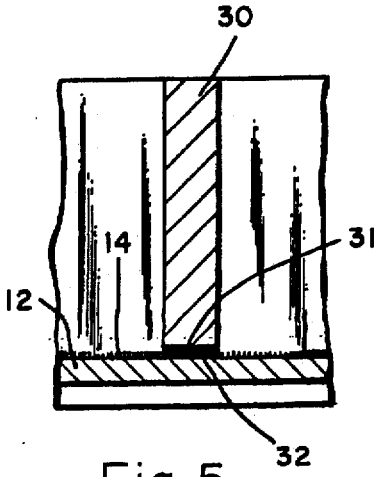
Fig. 5.

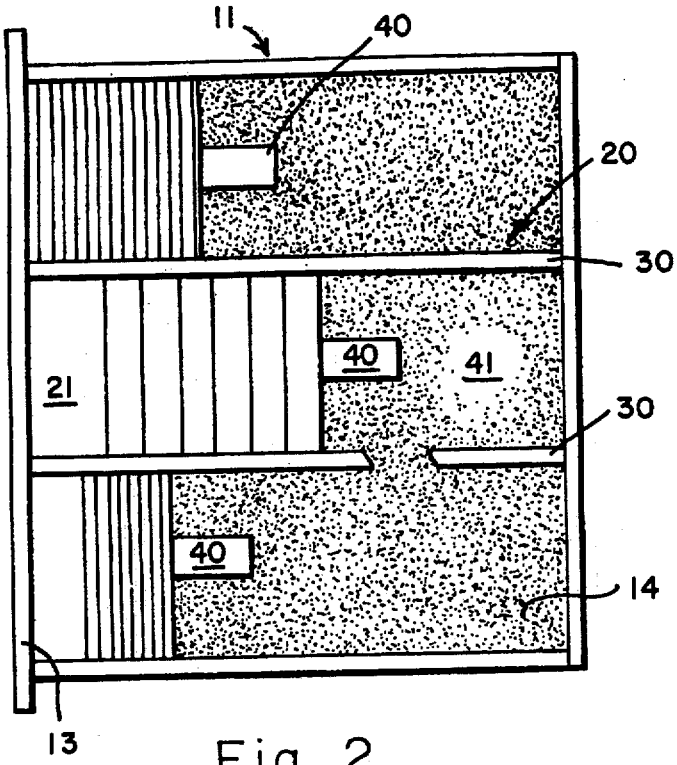
Fig. 2.
Fig. 9.
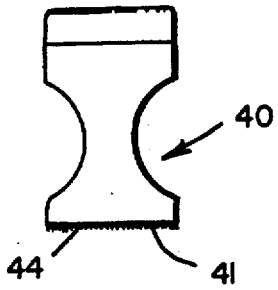
Fig. 8.
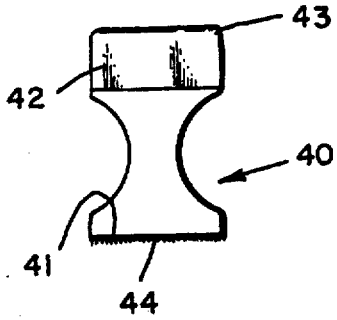
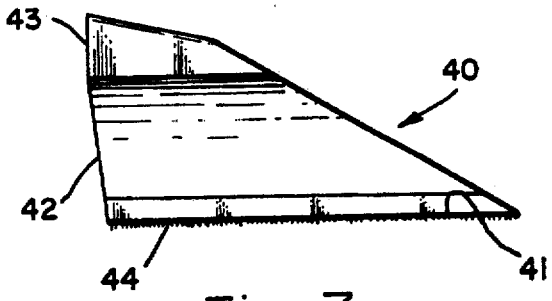
Fig. 7.
Fig. 6.
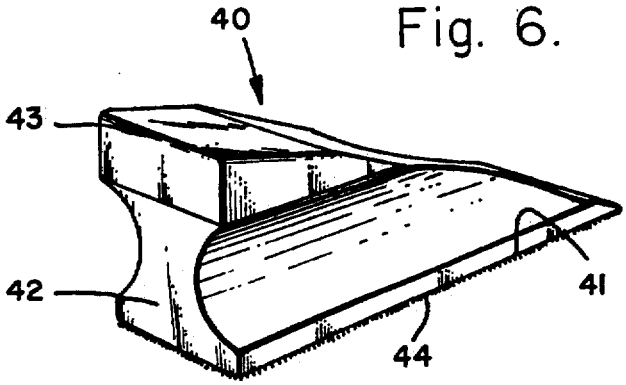

ADJUSTABLE STORAGE SYSTEM FOR AUDIO AND/OR VIDEO MEDIA

BACKGROUND OF THE INVENTION

1. Field of the Invention

This invention relates to an adjustable storage system for storing audio and/or video media, such as cassettes and diskettes, and other media, such as books, for use with a cabinet and more particularly to an adjustable storage system for storing audio and/or video media and/or other media of different sizes.

2. Description of the Prior Art

U.S. Pat. No. 4,705,169, entitled Multiple Cassette Storage Tray, issued to Patrick Mastronardo on Nov. 10, 1987, teaches a storage tray which is constructed with a plurality of parallel compartments. Each compartment is formed so as to receive two unboxed cassettes, one boxed cassette, an 8-track cartridge or an 8 millimeter video boxed cassette. The unboxed cassettes are held in place by flexible wall portions for engaging the end ribs of a conventional unboxed cassette. The bottom portion or surface of the tray is free of upwardly protruding members so as to give a clean aesthetically acceptable appearance.

U.S. Pat. No. 4,712,679, entitled Organizer for Compact Disc Albums and the Like, issued to Gary C. Lowe on Dec. 15, 1987, teaches a container for thin rigid envelopes. Each envelope is a solid and has length greater than width and thickness much less than width—such as the package for a compact disc record album—having connected lower and upper levels. The lower level defines transverse and longitudinal axes of the container as well as a number of cavities with upwardly-disposed open ends. The upper level includes an exterior retaining wall and opposed ledges extending at an angle from the the wall. An envelope may be inserted, width-edge down, into and held in one of the cavities; alternatively, such envelope may be placed on the upper level, length-wise on its lower edge and transverse the longitudinal axis of the container, with its lower corners supported, respectively, by the ledges. A spacer may be inserted into a cavity to separate the envelopes into distinct organizational groupings.

U.S. Pat. No. 4,779,730, entitled Media Box Storage Container, issued to John W. Hartsfield, Roger V. Meuter and John G. Tanner on Oct. 25, 1988, teaches a storage container which stores media boxes for magnetic tape cassette, compact disc and digital audio tape and which is formed of soft, pliable plastic. The storage container is open-topped and includes a plurality of parallel cross-ribs integrally formed with the bottom and the side walls of the container. The cross ribs in combination with the bottom and walls of the storage container define chambers for receiving the media boxes to be stored in the storage container. Located at either end of the box chambers are integral protrusions which frictionally engage the ends of the media boxes stored in the storage container.

U.S. Pat. No. 4,518,084, entitled Storage System for Either Boxed or Unboxed Cassettes, issued to Joseph L. Berkman on May 21, 1985, and U.S. Pat. No. 4,432,453, entitled Storage System for Either Boxed or Unboxed Cassettes, issued to Joseph L. Berkman on Feb. 21, 1984, both teach a case which has at least one row and a plurality of tandem compartments for interchangeably receiving and storing either a single boxed cassete or two unboxed cassettes in any compartment. The case has opposite side walls which are connected by a bottom wall. The compartments are disposed parallel and transverse to the opposite side walls. Each compartment includes a pair of projections separating and dividing the compartment into storage zones on both sides of the projections. The opposite side walls define pairs of vertical ribs for guiding and securely retaining a single boxed cassette in place atop the projections. The opposite side walls also define vertical end stops adjacent the ribs for limiting transverse movement of unboxed cassette stored and securely retained between the projections and opposite guides projecting inwardly from the side walls.

U.S. Pat. No. 4,432,454, entitled Compartmentalized Document Carrier Carton, issued to Otis J. Bloom on Feb. 21, 1984, teaches a document carrier carton which provides variable size compartments for the transportation of bank drafts and checks in pre-arranged order with reduced likelihood of damage to the bank drafts and checks. Either the carton or an insert for the carton includes a bottom wall having a plurality of U-shaped slits which define upwardly bendable partitions and side walls having U-shaped slits which define inwardly bendable spaced abutment member for holding the partition members in an erected positon.

U.S. Pat. No. 4,744,463, entitled Storage Display Tray, issued to Richard Merzon on May 17, 1988, teaches a storage display tray which selectively retains either or both a relatively small rectangular in cross-section object or a relatively large rectangular in cross-section object. The storage display tray is particulary suited for use in connection with tape cassettes which have pinch roller openings along a longitudinal edge thereof and the relatively larger containers, such as boxes, for the cassettes so that either a cassette alone, or a boxed cassette may be selectively retained. The storage display tray is formed of a plurality of elongated compartments defined by a longitudinally extending partition flange between each adjacent compartment. A laterally extending wall is provided spaced apart more than the length of a relatively larger object such as a boxed cassette. A bottom wall extends between the longitudinally and laterally extending walls and an engaging element is formed on the bottom wall to frictionally engage in the cassette pinch roller opening to grip the unboxed cassette. A rib on the laterally extending walls in each compartment is positioned to frictionally engage the ends of the relatively larger boxed cassette. Thus unboxed cassettes or boxed cassettes may be selectively held with little or no tray deformation. Each tray compartment is provided with either or both color and/or color tone coded and alpha numeric indicia, and correspondingly marked labels also color coded and/or color tone coded are provided for securement to the unboxed cassettes or unboxed cassettes to be retained in the tray compartments. U.S. Pat. No. 3,756,383 teaches a storage case which is formed with compartments defined by spaced horizonal and vertical ribs serving to accommodate therebetween either a boxed or unboxed cassette.

U.S. Pat. No. 4,707,247, entitled Disk Cassette Storing, issued to Robert L. Savoy on Nov. 17, 1987, teaches a storage cabinet for storing in each of a number of stacked storage regions a boxed compact disk, a boxed compact cassette or a pair of unboxed cassette which includes a pair of opposed parallel side walls cantilevered from a rear wall and having stacked opposed pairs of protrusions defining a first storage region extending between the side walls for receiving a boxed compact disk or a pair of unboxed cassettes and each having a shelf spaced from the rear wall for defining a second storage region of width corresponding to that of a boxed compact cassette depth less than the width of a boxed compact cassette for storing a boxed cassette so that it protrudes slightly beyond free ends of the side walls.

U.S. Pat. No. 4,368,934, entitled Storage Cabinet for Cassettes Boxes, issued to Giles N. Somers on Jan. 18, 1983, teaches a cabinet for holding cassette boxes. The cabinet simplifies putting cassettes in order, extracting the cassettes from the cabinet and avoiding throwing away the cassette boxes.

U.S. Pat. No. 4,643,496, entitled Storage and Security System for Cassette-Like Objects, issued to Ernest A. Dahl on Feb. 17, 1987, teaches a cabinet arrangement for the storage and use of cassettes for storing microfilm boxes and data tape cartridges. The cabinet in one form is intended to be placed upon a table adjacent a person work station and in another stacked form intended to be used from a floor position. The cabinet arrangement includes a, plurality of open-faced boxes individually rotatively mounted on a swivel base assembly. The boxes can be aligned in any combination of the open-faced sides facing outwardly for access to the microfilm or inwardly for preventing access to the cassettes.

U.S. Pat. No. 4,679,757, entitled Adjustable Bookholder, issued to Fred P. Mussari on July 14, 1987, teaches an adjustable bookstand or bookholder which includes a retractable easel mounted on the spine for movement between extended and retracted positions. The easel includes brace members which are easily and conveniently adjusted to change the supported angle of inclination as desired. Releasable connectors are provided for securing the easel in retracted positions within the bookholder. The lower easel portion and connector include sections of hook-and-loop type material like that sold under the registered trademark, VELCRO, for positively retaining the easel in either a retracted position or an adjustable, extended position.

U.S. Pat. No. 4,591,148, entitled Portable Clamp and Anchor, issued to Olin Slater on May 27, 1986, teaches a portable clamp and anchor which restrains a person's feet during his sit-up exercises and which has two clamp pieces which are adjustably positioned on the bottom of a door and a foot restraining piece which is adjustably positioned relative to the clamp pieces. Hook and loop fasteners are used to connect the pieces together during use.

SUMMARY OF THE INVENTION

In view of the foregoing factors and conditions which are characteristic of the prior art it is the primary object of the present invention to provide an adjustable storage system which can store audio and/or video media and/or other media of different sizes.

In accordance with the present invention an embodiment of an adjustable storage system for storing audio and/or video media, such as either cassettes or diskettes, and/or other media, such as books, which are arranged in a row is described. The adjustable storage system is used in combination with a cabinet which has at least one drawer with a bottom wall and a front wall. The adjustable storage system includes a plurality of stops and a plurality of dividers. Each stop has a bottom surface and a front surface which is at an angle of slightly more than ninety degrees to the bottom surface. The top edge of the stop contacts the rear wall of the last of the audio and/or video media and/or other media in the row. Each divider has a bottom surface. A rectangular sheet of a first velcro material with either loops or hooks is mechanically coupled to the bottom wall of each drawer. A piece of a second velcro material with either hooks or loops is mechanically coupled to the bottom surface of each stop and each divider. Each stop and each divider is detachably coupled to the bottom wall of each drawer of the cabinet. The adjustable storage system may be adjusted to store cassettes, diskettes and other media of different sizes by moving each of the plurality of stops and each of the plurality of dividers.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a cabinet with an open drawer.

FIG. 2 is a top plan view of the open drawer of the cabinet FIG. 1 in which an adjustable storage system, which stores audio and/or video media and/or other media and which has been constructed in accordance with the principles of the present invention, is disposed.

FIG. 3 is front elevation of the open drawer of FIG. 1.

FIG. 4 is cross-sectional view of the open drawer of FIG. 1 taken along lines 4—4 of FIG. 3 and a side elevation of one of the dividers of the adjustable storage system of FIG. 2.

FIG. 5 is cross-sectional view of the divider of FIG. 4 taken along lines 5—5 of FIG. 4.

FIG. 6 is a perspective view of a stop of the adjustable store system of FIG. 2.

FIG. 7 is a side elevation of stop of FIG. 6.

FIG. 8 is a front elevation of the stop of FIG. 6.

FIG. 9 is a rear elevation of the stop of FIG. 6.

DESCRIPTION OF THE PREFERRED EMBODIMENT

In order to understand the present invention it is necessary to refer to the following description of its preferred embodiment in conjunction with the accompanying drawing. Referring to FIG. 1 in conjunction with FIG. 2 a cabinet 10 includes at least one drawer 11 with a bottom wall 12 and a front wall 13. A rectangular sheet 14 of a first velcro material with either loops or hooks is mechanically coupled to the bottom wall 12 of each drawer 11. The cabinet 10 is used in combination with a first adjustable storage system 20 for storing audio and/or video media 21, such as either cassettes or diskettes, and/or other media, such as books, which are arranged in a row.

Referring to FIG. 3 in conjunction with FIG. 2, FIG. 4 and FIG. 5 the first adjustable storage system 20 includes a plurality of dividers 30. Each divider 30 has a bottom surface 31. A piece 32 of a second velcro material with either hooks or loops is mechanically coupled to the bottom surface 31 of each divider 30. Each divider 30 is detachably coupled to the bottom wall 12 of each drawer 11 of the cabinet 10. The adjustable storage system 20 may be adjusted to store cassettes, diskettes and/or other media of different sizes by moving each of the plurality of dividers 30.

Referring to FIG. 6 in conjunction with FIG. 2, FIG. 7, FIG. 8 and FIG. 9 the first adjustable storage system 20 also includes a plurality of stops 40. Each stop 40 has a bottom surface 41 and a front surface 42 which is at an angle of slightly more than ninety degrees to the bottom surface 41. The top edge 43 of the stop 40 contacts the rear wall of the last of the audio and/or video media 21 and/or other media in the row. A piece 44 of a second velcro material with either hooks or loops is mechanically coupled to the bottom surface 41 of each stop 40. Each stop 40 is detachably coupled to the bottom wall 12 of each drawer 11 of the cabinet 10. The adjustable storage system 20 may be adjusted to store cassettes and diskettes of different sizes by moving each of the plurality of stops 40.

A second adjustable storage system for storing audio and/or video media and/or other media which are arranged in a row and disposed on a bottom wall such as a shelf or a bookcase. A rectangular sheet of a first velcro material with either loops or hooks is mechanically coupled to the bottom wall. The adjustable storage system includes a first stop and a second stop. The first stop has a bottom surface and a front surface which is at an angle of slightly more than ninety degrees to said bottom surface. The top edge of the first stop contacts the rear wall of the last of the audio and/or video media and/or media in the row. The second stop is also mechanically coupled to the bottom wall in order to hold upright the first of the audio and/or video media and other media adjacent to its front surface. A piece of a second velcro material with either hooks or loops is mechanically coupled to the bottom surface of each first stop. Each first stop is detachably coupled to the bottom wall. The adjustable storage system may be adjusted to store cassettes, diskettes and other media of different sizes by moving each of the plurality of stops.

From the foregoing it can be seen that an adjustable storage system for storing audio and/or video media and/or media has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An adjustable storage system for storing audio and/or video media for use with a cabinet which has at least one drawer with a bottom wall a front wall and a back wall wherein audio and/or video media of different heights, different widths and different thicknesses are arranged in a plurality of rows on the bottom wall of the drawer each of the rows extending from the front wall to the back wall, said adjustable storage system for storing audio and/or video media comprising:

a. a plurality of stops, each of which has a bottom surface and a front surface which is at an angle of slightly more than ninety degrees to said bottom surface and the top edge of which contacts the rear wall of the last of the audio and/or video media in each row;

b. stop coupling means for detachably coupling one of said plurality of stops to the bottom wall of the drawer whereby said adjustable storage system for storing audio/or visual media may be adjusted to store additional audio and/or video media in each row by moving one of said plurality of stops;

c. a plurality of dividers, each of which has a bottom surface, each of said plurality of dividers being disposed between two rows of the audio and/or video media; and d. divider coupling means for detachably coupling each of said plurality of dividers to the bottom wall of each drawer whereby said adjustable storage system for storing audio and/or visual media may be adjusted to store wider audio and/or video media in each row by moving one of said plurality of dividers.

2. An adjustable storage system for storing audio and/or video media according to claim 1 wherein said divider coupling means comprises:

a. a rectangular sheet of a first velcro material with loops which is mechanically coupled to the bottom wall of each drawer; and b. a piece of a second velcro material with hooks which is mechanically coupled to the bottom surface of each of said plurality of dividers.

3. An adjustable storage system for storing audio and/or video media according to claim 1 wherein said divider coupling means comprises:

a. a rectangular sheet of a first velcro material with hooks which is mechanically coupled to the bottom wall of each drawer; and b. a piece of a second velcro material with loops which is mechanically coupled to the bottom surface of each of said plurality of dividers.

* * * * *